US011319702B2

(12) United States Patent
Gillespie et al.

(10) Patent No.: US 11,319,702 B2
(45) Date of Patent: May 3, 2022

(54) APARTMENT BALCONY

(71) Applicant: WESTBANK PROJECTS CORP., Vancouver (CA)

(72) Inventors: Ian Gillespie, Vancouver (CA); Alex J. Feldman, Vancouver (CA); Alexander J. Stone, Burnaby (CA); Brian D. Giesbrecht, Vancouver (CA)

(73) Assignee: WESTBANK PROJECTS CORP., Vancouver (CA)

( * ) Notice: Subject to any disclaimer, the term of this patent is extended or adjusted under 35 U.S.C. 154(b) by 0 days.

(21) Appl. No.: 17/309,034

(22) PCT Filed: Oct. 30, 2018

(86) PCT No.: PCT/CA2018/051375
§ 371 (c)(1),
(2) Date: Apr. 19, 2021

(87) PCT Pub. No.: WO2020/087150
PCT Pub. Date: May 7, 2020

(65) Prior Publication Data

US 2021/0238840 A1 Aug. 5, 2021

(51) Int. Cl.
*E04B 1/00* (2006.01)
*E04B 5/10* (2006.01)

(52) U.S. Cl.
CPC ..... *E04B 1/003* (2013.01); *E04B 5/10* (2013.01)

(58) Field of Classification Search
CPC ..... E04B 1/003; E04B 5/10
(Continued)

(56) References Cited

U.S. PATENT DOCUMENTS 1,170,305 A 2/1916 Marshall
3,154,888 A * 11/1964 Graham ..... E04H 9/10 52/81.4

(Continued)

FOREIGN PATENT DOCUMENTS

CN 203782871 U 8/2014
CN 105756186 A 7/2016

(Continued)

OTHER PUBLICATIONS

17309034_Espacenet_Translation_Original_Document_JPH05222761_A.pdf published to Yamamoto Akio et al. granted Aug. 31, 1993 retrieved and translated Jul. 1, 2021 (Year: 2021).*

(Continued)

*Primary Examiner* — Brian D Mattei
*Assistant Examiner* — Joseph J. Sadlon
(74) *Attorney, Agent, or Firm* — McKee, Voorhees & Sease, PLC

(57) ABSTRACT

A balcony (10) for attachment to a building wall to provide privacy and views, and comfortable outdoor living space for apartment dwellers. The balcony has a floor (16) having a first edge (18) for abutment to the building wall, a perimeter wall (14) having a first end (22) and a second end (24), the first end and the second end being spaced apart and adjacent to the floor first edge (18). The floor extends between the perimeter wall and the floor first edge. The perimeter wall has a top edge (26) that is higher at the first end (22) than at the second end (24). Connectors (36, 38) are provided proximate to the floor first edge and proximate to the perimeter wall upper edge for attaching the balcony to the building wall.

23 Claims, 5 Drawing Sheets

(58) Field of Classification Search
USPC ..... 52/73, 74; D6/332; D25/58, 138
See application file for complete search history.

(56) References Cited

U.S. PATENT DOCUMENTS

| | | | | | |
|---|---|---|---|---|---|
| 3,646,896 | A * | 3/1972 | Derujinsky | A47B 11/00 | 108/139 |
| 3,921,356 | A * | 11/1975 | Hughes | E04B 5/12 | 52/299 |
| 4,496,266 | A * | 1/1985 | Ruckstuhl | E01C 5/00 | 404/41 |
| D304,529 | S * | 11/1989 | Hontz | A47J 27/14 | D6/332 |
| 5,109,956 | A * | 5/1992 | Casale | A47J 27/14 | 186/41 |
| 5,199,231 | A * | 4/1993 | Dever | E04B 1/003 | 52/176 |
| D358,662 | S * | 5/1995 | Good | E04C 3/32 | D25/58 |
| D436,184 | S * | 1/2001 | Reiter | 52/73 | |
| 6,240,686 | B1 * | 6/2001 | Mill | E04B 1/3205 | 52/223.1 |
| 6,453,826 | B1 * | 9/2002 | Fookes | A47B 17/065 | 108/50.11 |
| 6,742,311 | B2 * | 6/2004 | Fortier | E04B 1/003 | 52/183 |
| 7,228,669 | B1 * | 6/2007 | Yaraschefski | A47B 5/00 | 108/144.11 |
| 7,866,636 | B1 * | 1/2011 | Hansen | E04F 11/1851 | 256/65.14 |
| 8,002,642 | B2 * | 8/2011 | Guerzini | A63G 31/00 | 472/116 |
| 8,661,768 | B2 * | 3/2014 | Alkhrdaji | E04B 1/003 | 52/741.15 |
| 8,959,849 | B1 * | 2/2015 | DiGirolamo | E04B 1/003 | 52/182 |
| D727,638 | S * | 4/2015 | Tsuchiyama | E04B 1/3205 | D6/332 |
| 9,797,123 | B2 * | 10/2017 | Ryan | E04B 1/003 | 52/176 |
| 10,100,510 | B1 * | 10/2018 | Al Doukhi | E04B 1/003 | 52/79.6 |
| 10,309,094 | B2 * | 6/2019 | Avelin | E04G 23/0266 | |
| 10,383,464 | B2 * | 8/2019 | Morin | A47G 7/044 | |
| 2003/0167701 | A1 * | 9/2003 | Rich | E04B 1/003 | 52/79.6 |
| 2013/0097949 | A1 * | 4/2013 | Hirata | E04F 13/08 | 52/302.1 |
| 2014/0311077 | A1 * | 10/2014 | Firouz | E04C 3/32 | 52/474 |
| 2019/0048584 | A1 * | 2/2019 | Lestini | E04B 5/10 | |

FOREIGN PATENT DOCUMENTS

| | | | | |
|---|---|---|---|---|
| CN | 207685993 | U | 8/2018 | |
| DE | 3326269 | A1 * | 1/1985 | E04B 1/003 |
| DE | 19652165 | A1 | 6/1998 | |
| DE | 102015007324 | A1 * | 12/2016 | E04B 1/3412 |
| EP | 0058143 | A1 * | 8/1982 | E04B 1/003 |
| EP | 0058143 | A1 | 8/1982 | |
| EP | 3133220 | A2 | 2/2017 | |
| FI | 125419 | B | 10/2015 | |
| JP | 04047046 | A * | 2/1992 | E04B 5/10 |
| JP | 05222761 | A | 8/1993 | |
| JP | 06146390 | A * | 5/1994 | |
| JP | 2006057376 | A | 3/2006 | |
| NL | 1021465 | C1 | 3/2004 | |
| RU | 2133319 | C1 | 7/1999 | |
| WO | WO-9401640 | A1 * | 1/1994 | E04F 11/18 |
| WO | 2013122478 | A1 | 8/2013 | |
| WO | WO-2014199964 | A1 * | 12/2014 | E04B 5/10 |

OTHER PUBLICATIONS

"Wettbewerbe—BAKU—Baumen mit Kunststoff", http://kunststoffbauten.de/de/bauen/wettbewerbe, 3 pages, accessed Sep. 5, 2018.

"Salle Wilfrid-Pelletier", https://placedesarts.com/en/produce-event/salle-wilfrid-pelletier, 2 pages, accessed Jul. 6, 2021.

* cited by examiner

FIG. 1
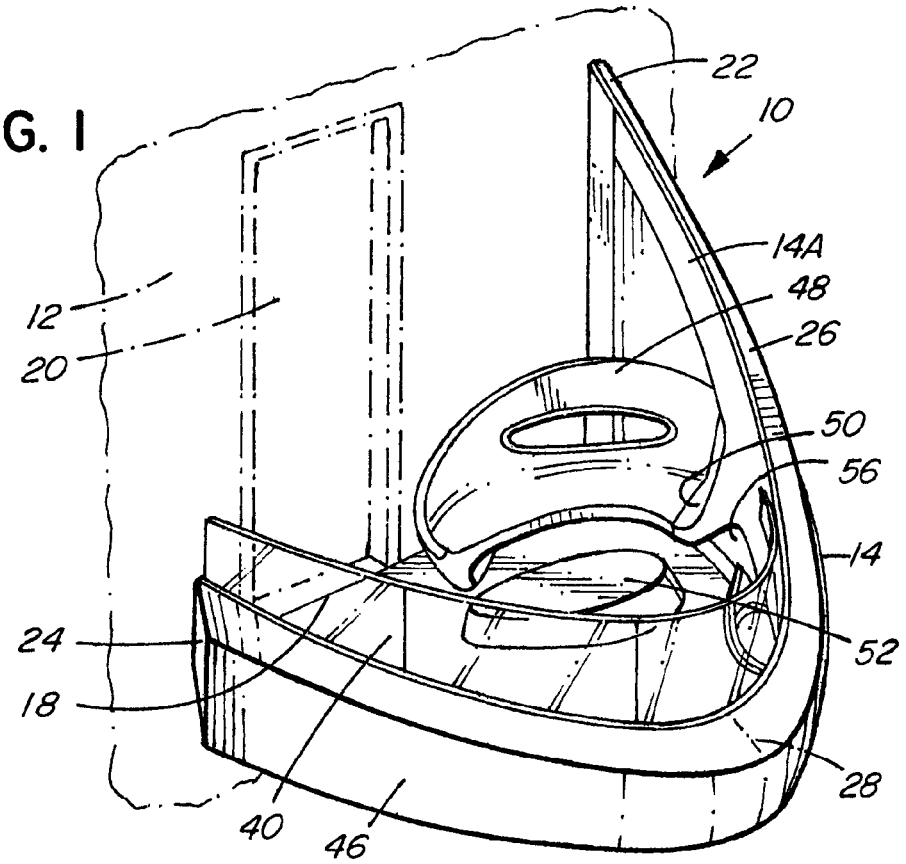
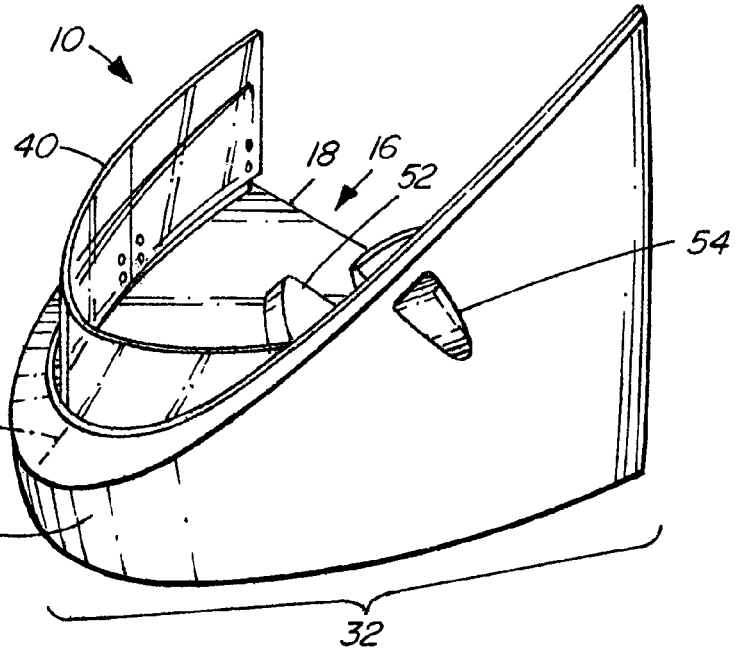
FIG. 2

FIG. 7
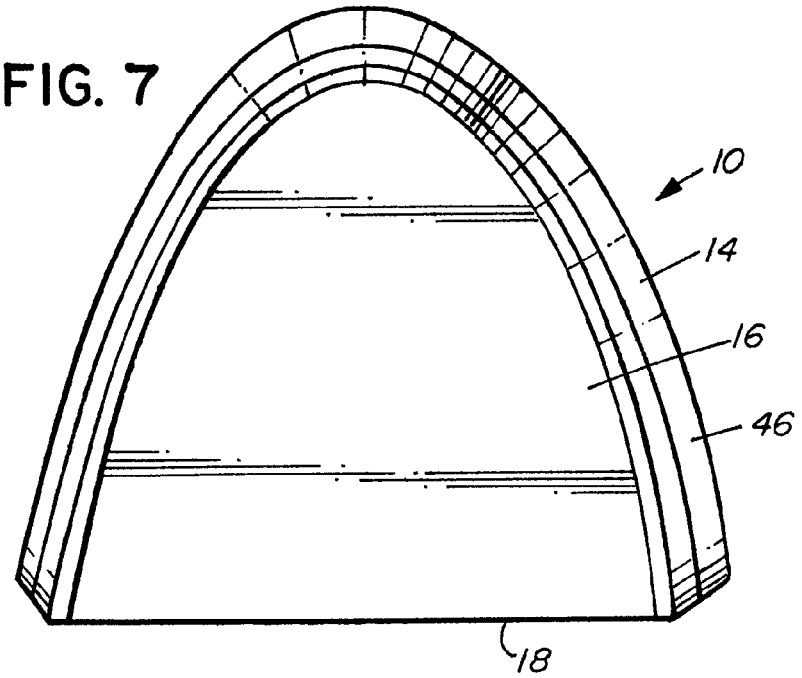
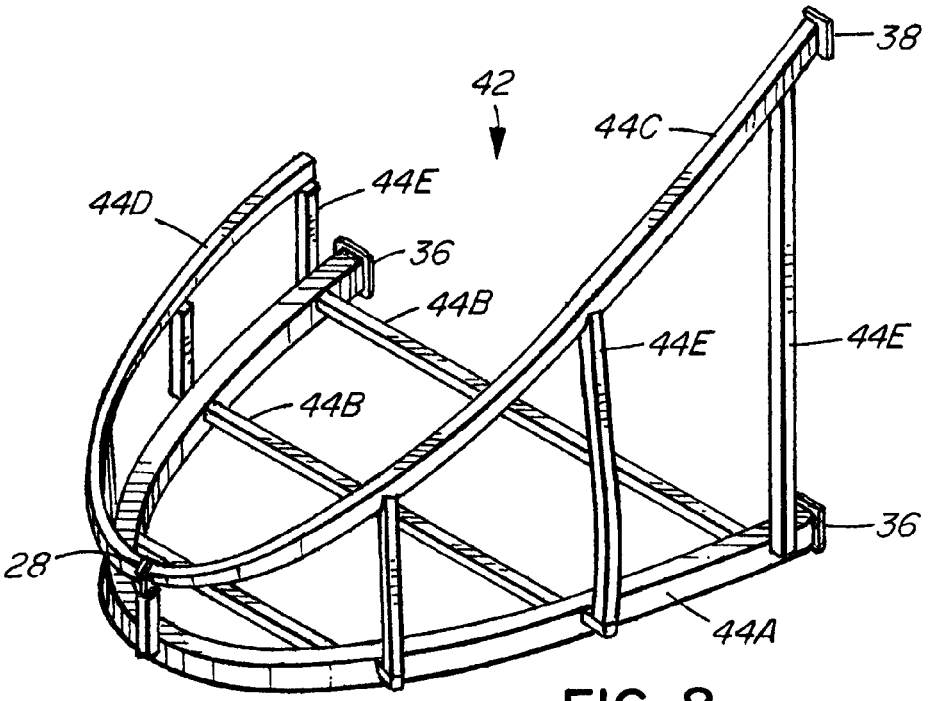
FIG. 8

APARTMENT BALCONY

CROSS REFERENCE TO RELATED APPLICATIONS

This is a U.S. National Phase application claiming priority to PCT/CA2018/051375, filed Oct. 30, 2018, the entire contents of which are hereby expressly incorporated by reference in its entirety including, without limitation, the specification, claims, and abstract, as well as any figures, tables, or drawings thereof.

TECHNICAL FIELD

The invention pertains to balconies for buildings, in particular balconies for apartments and other residential buildings.

BACKGROUND OF THE INVENTION

Balconies are a common feature of apartment buildings. They are typically plain rectangular structures with a surrounding railing, exposed to wind and weather. As a result of this design, they are often underutilized and fail to provide useful, comfortable and reasonably private living space to the apartment occupants. Examples of such prior art balconies are disclosed in the patent literature in WO 2013/122478 (Myklebust) and NL 1021465 (van Ghent). Even the balconies of luxury apartments, which may be relatively large and have tiled floors, balustrades and clear glass railings, have these same drawbacks.

There is accordingly a need for a form of balcony that affords more pleasant and useful outdoor living space to apartment dwellers.

SUMMARY OF THE INVENTION

According to one aspect of the invention, there is provided a balcony for attachment to a building wall. The balcony has a floor having a first edge for abutment to the building wall and a perimeter wall having a first end and a second end, the first end and the second end being spaced apart and adjacent to the floor first edge, the floor extending between the perimeter wall and the floor first edge, the floor having a top surface. The perimeter wall has a top edge that is higher at the first end than at the second end, relative to the floor top surface.

According to a further aspect of the invention, there is provided a balcony as aforesaid, further comprising first attachment means proximate to the floor first, and second attachment means proximate to the perimeter wall upper edge, for attaching the balcony to the building wall.

According to a further aspect of the invention, there is provided a balcony as aforesaid, wherein the perimeter wall has a first section, a second section, and an intermediate point between the first end and the second end, wherein the first section extends between the first end and the intermediate point, and the second section extends between the second end and the intermediate point. The perimeter wall top edge of the first section slopes downward from the first end to the intermediate point, relative to the floor top surface.

In addition to the exemplary aspects and embodiments described above, further aspects and embodiments will become apparent by reference to the drawings and the following detailed description.

BRIEF DESCRIPTION OF THE DRAWINGS

Exemplary embodiments are illustrated in referenced figures of the drawings. It is intended that the embodiments and figures disclosed herein are to be considered illustrative rather than restrictive.

FIG. 1 is a perspective view of the balcony according to one embodiment of the invention, in place on the wall of a building.

FIG. 2 is another perspective view of the balcony of FIG. 1.

FIG. 7 is a bottom plan view thereof.

FIG. 8 is a perspective view of the structural frame of the balcony.

DETAILED DESCRIPTION

Figure 3:
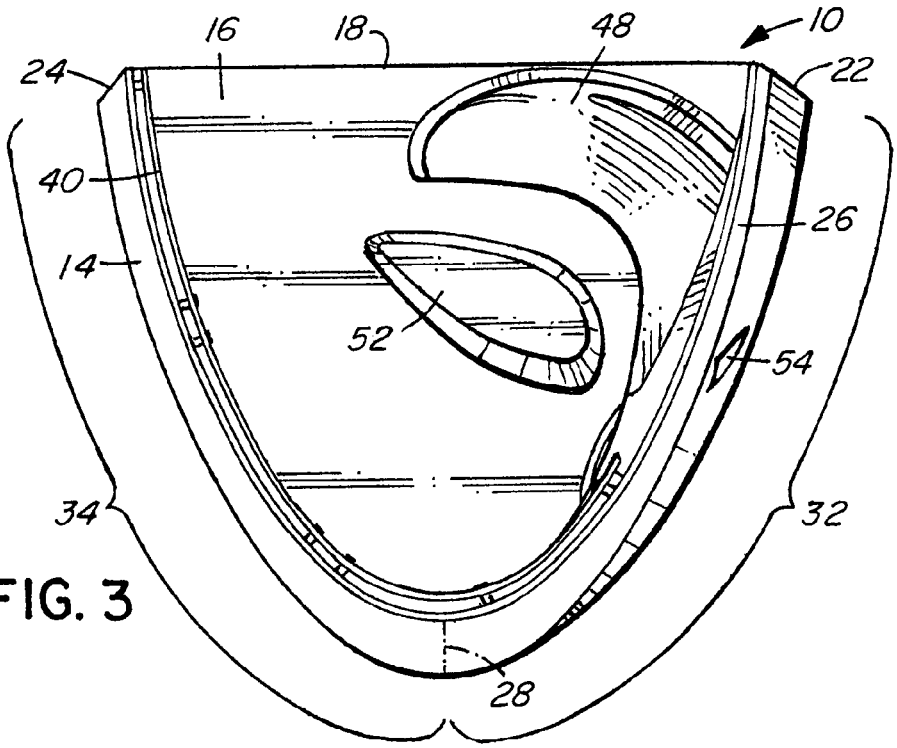
FIG. 3 is a top plan view thereof.

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

Referring to FIGS. 1 to 6, the balcony 10 is a prefabricated structure to be attached to the external wall 12 of a building, such a residential apartment building. When installed on the building, the balcony 10 is positioned so that a doorway 20 of an apartment unit provides access onto the balcony.

The balcony 10 has a perimeter wall 14 and a floor 16. The floor 16 has an edge 18 that is adjacent to the building wall 12 when the balcony is installed on a building. The balcony is generally convex in shape, relative to the floor edge 18, with the floor extending between the perimeter wall 14 and the edge 18.

Figure 5:
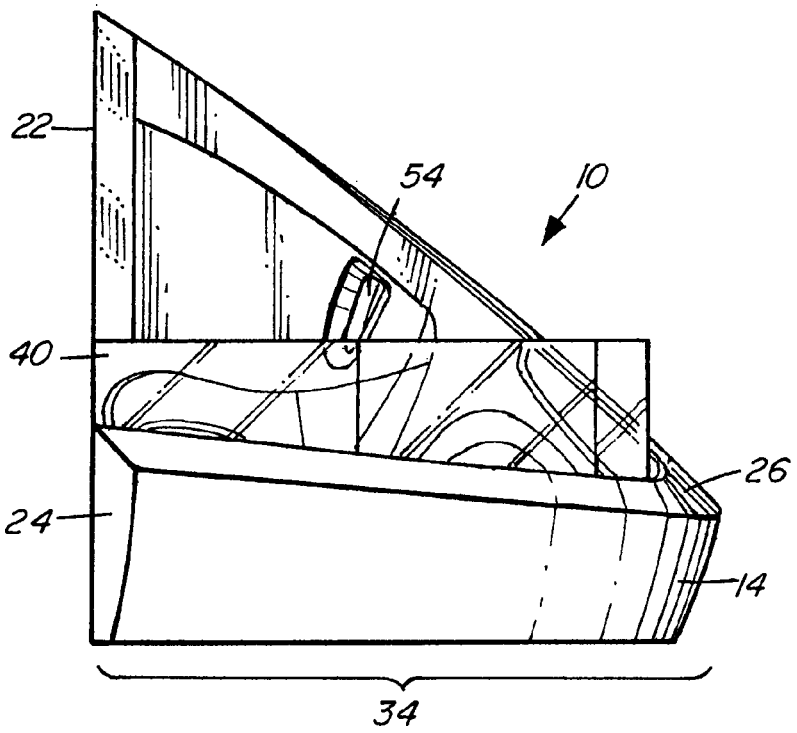
FIG. 5 is a left side elevation view thereof.
Figure 6:
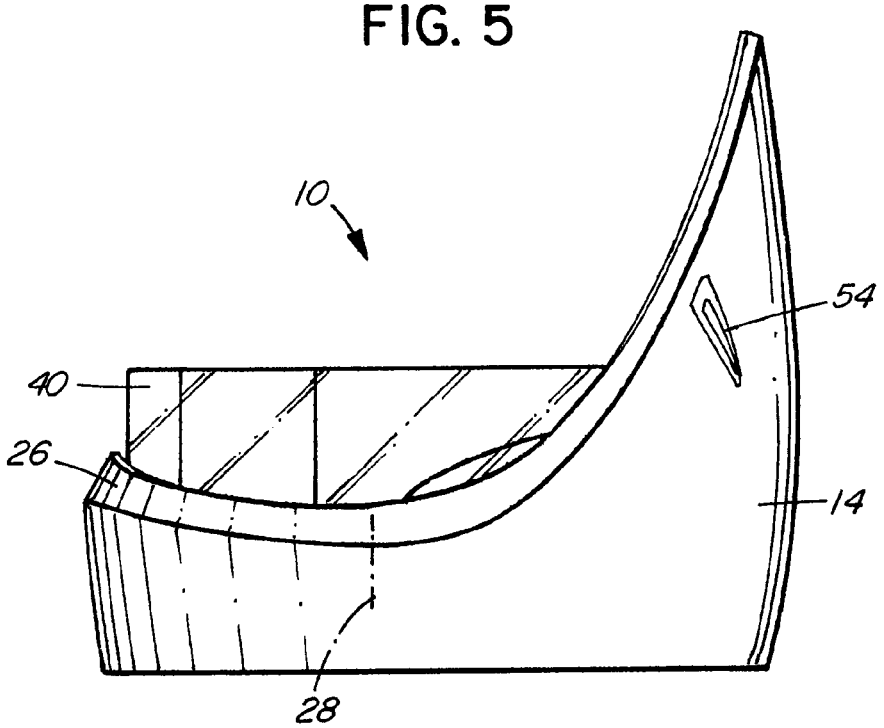
FIG. 6 is a front elevation view thereof

The perimeter wall 14 is configured so as to provide shelter and privacy on one side of the balcony 10, while providing views on the other side. At a first end 22 of the perimeter wall, the perimeter wall is high, and at a second end 24 it is low. The top edge 26 of the perimeter wall slopes downward from the first end 22 to an intermediate point 28 between the two ends 22, 24. The intermediate point 28 may be at the farthest extension of the balcony from the edge 18, as in the illustrated embodiment, in which case it is halfway between the two ends. Alternatively, it may be at a selected position on either side of the halfway point. Between the intermediate point 28 and the second end 24 of the perimeter wall 14, the perimeter wall is relatively low. Thus, the perimeter 14 wall has two sections, a first section 32 between the first end 22 and the intermediate point 28, and a second section 34 between the intermediate point 28 and the second end 24, as shown in FIG. 3. The first section 32 provides shelter and privacy to the user and the second section 34 affords views. The top edge 26 of the perimeter wall in the second section 34 slopes slightly upward from the intermediate point 28 to the second end 24 of the perimeter wall, as best seen in FIG. 5. The perimeter wall is accordingly lowest at the intermediate point 28, as best seen in FIG. 6. The top edge 26 forms a smooth, uninterrupted curve from the first end 22 to the second end 24 of the perimeter wall. In one embodiment, as shown in FIG. 3, the perimeter wall 14 is in the form of a parabola, in the plane of the floor top surface 30, and the intermediate point 28 is at the vertex of the parabola.

In another embodiment, the top edge 26 in the second section 34 may be substantially parallel to the floor top surface 30.

The underside of the balcony is flat, as shown in FIG. 7. When the balconies 10 are affixed to a building so that adjacent building floors have one balcony above the other, the floor of the upper balcony provides shelter for the lower balcony. When the balconies 10 are affixed to a building so that adjacent units on the same floor have balconies within view of each other, the balconies may be oriented so that the respective second sections 34 of the balconies face in the same direction; in this way, the "privacy side" of one balcony is oriented towards the "view side" of the adjacent balcony, providing more privacy from the adjacent balcony.

The balcony 10 attaches to the building wall 12 both at the level of the floor 16 and at the first end 22 of the perimeter wall 14, proximate to its top edge 26. At the floor, connectors 36 are provided at the ends of the floor edge 18, proximate to the first end 22 and the second end 24 of the perimeter wall 14. On the perimeter wall, a connector 38 is provided on the first end 22, proximate to the top edge 26 of the wall. The connectors 36, 38 may be of various conventional types. They connect with mating connectors (not shown) on the building wall 12.

The perimeter wall 14 is relatively low in the second section 34, and in the portion of the first section 32 proximate to the intermediate point 28. Accordingly, a railing 40 is provided, extending along those portions of the perimeter wall and affixed to its inner side 14A. In the first section 32, the railing ends at a point between the intermediate point 28 and the first end 22 of the perimeter wall. The railing may comprise tempered or laminated glass panels, with a metal cap covering the top edge of the glass.

The balcony 10 has a structural framework that is covered with cladding. Referring to FIG. 8, the framework 42 comprises structural members 44 made of tubular steel. One frame member 44A, generally parabolic in shape, is provided for the base of the perimeter wall, braced by cross members 44B. Two curved frame members 44C and 44D are provided for the upper part of the perimeter wall, joined at the intermediate point 28 of the wall. A set of upright frame members 44E attach the upper members 44C, 44D to the base member 44A. The floor-level connectors 36 are located at the two ends of the base member 44A, and the perimeter wall connector 38 is located at the free end of the upper member 44C, for attachment of the balcony to the building wall 12.

The framework 42 is covered by cladding 46. The cladding 46 may comprise concrete shell panels, which may be reinforced. In some embodiments, the cladding may comprise other materials, such as aluminum or stainless steel panels.

Figure 4:
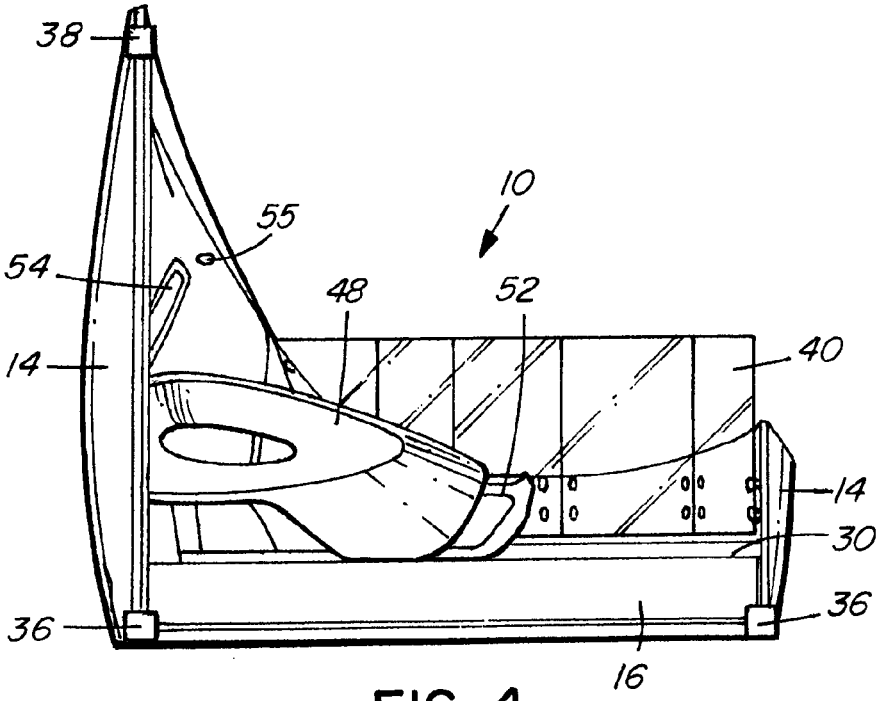
FIG. 4 is a back elevation view thereof.

The balcony 10 includes a seating element 48 which is integral with the first section 32 of the perimeter wall 14. The inner side 14A of the perimeter wall is shaped to form an inclined backrest element 50 as part of the seating element. Optionally, a movable ottoman 52 may be provided on the balcony, with the seating element 48 being configured to permit the ottoman to be nested against it. A window opening 54 and a light 55 are provided in the perimeter wall, adjacent to the seating element, as best seen in FIG. 4.

The balcony also includes a plant-growing receptacle 56, formed in the inner side 14A of the first section 32 of the perimeter wall 14.

Figure 9A:
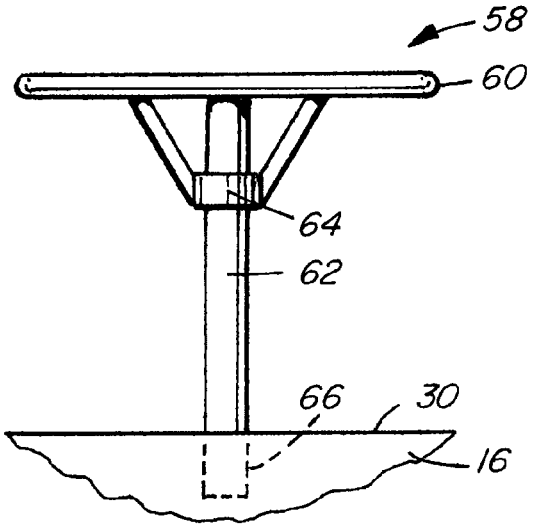
FIGS. 9A and 9B are elevation views of a collapsible table on the balcony, in the operative and collapsed positions, respectively.
Figure 9B:
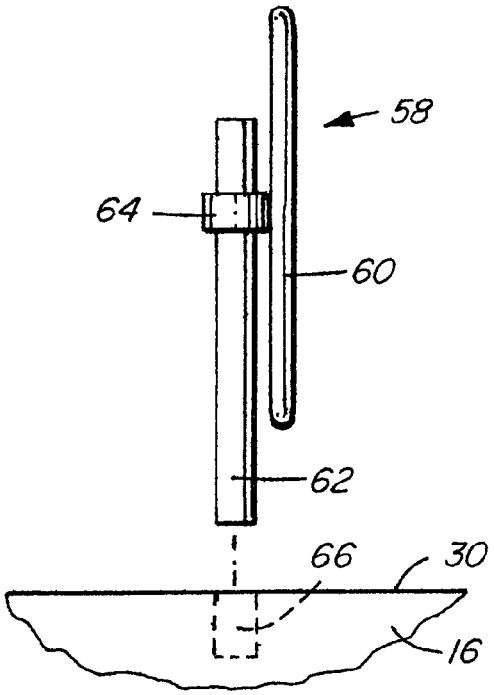

In some embodiments of the balcony 10, a collapsible table is provided adjacent to the seating element 48. Referring to FIGS. 9A and 9B, the table 58 comprises a table top 60 mounted on a cylindrical post 62 by means of a table swing support system 64 that is attached to the underside of the table top. The swing support system allows the table top 60 to be locked securely in a horizontal position for use as a table, and to pivot smoothly from a horizontal position to a vertical position to put the table away. A support receptacle 66 is recessed into the floor 16 of the balcony to removably receive the lower end of the post 62 and support the post in a vertical position. The support receptacle has indexing elements that interlock with mating indexing elements on the lower end of the post 62 to prevent rotation of the post and thereby maintain the table top in a desired orientation. To use the table, the post 62 is fitted into the support receptacle 66 and the table top 60 is locked in the horizontal position, shown in FIG. 9A. To put the table away, the table top is unlocked and pivoted into the vertical position and the post is withdrawn from the support receptacle 66, as shown in FIG. 9B. The table top 60 is shaped so as to fit within a cavity in the ottoman 52, so the table can be stored there when it is not in use.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are consistent with the broadest interpretation of the specification as a whole.

The invention claimed is:

1. A balcony for attachment to a building wall, comprising:

a floor-having a first edge for abutment to the building wall;

a perimeter wall having a first end and a second end, the first end and the second end being spaced apart and adjacent to the floor first edge;

the floor extending between the perimeter wall and the floor first edge, the floor having a top surface, wherein the balcony floor is convex in shape in the plane of the floor top surface, relative to the floor first edge;

the perimeter wall having a top edge that is higher at the first end than at the second end, relative to the floor top surface.

2. A balcony according to claim 1, further comprising:

first attachment means proximate to the floor first edge for attaching the balcony to the building wall; and second attachment means proximate to the perimeter wall upper edge for attaching the balcony to the building wall.

3. A balcony according to claim 2, wherein the second attachment means is proximate to the first end of the perimeter wall.

4. A balcony according to claim 1, wherein the perimeter wall has a first section, a second section, and an intermediate point between the first end and the second end, wherein the first section extends between the first end and the intermediate point, and the second section extends between the second end and the intermediate point.

5. A balcony according to claim 4, wherein the perimeter wall top edge of the first section slopes downward from the first end to the intermediate point, relative to the floor top surface.

6. A balcony according to claim 4, wherein the intermediate point is half-way between the first end and the second end of the perimeter wall.

7. A balcony according to claim 4, wherein the perimeter wall top edge of the second section slopes downward from the second end to the intermediate point, relative to the floor top surface.

8. A balcony according to claim 4, wherein the perimeter wall top edge of the second section is generally parallel to the floor top surface.

9. A balcony according to claim 4, wherein an inner side of the perimeter wall first section comprises a seating element integral therewith.

10. A balcony according to claim 4, wherein an inner side of the perimeter wall first section comprises a backrest integral therewith.

11. A balcony according to claim 4, wherein the perimeter wall first section has a window opening therein.

12. A balcony according to claim 4, further comprising a plant-growing receptacle in the perimeter wall first section.

13. A balcony according to claim 4, further comprising a railing extending above the perimeter wall second section.

14. A balcony according to claim 13, wherein the railing extends above a portion of the perimeter wall first section adjacent to the intermediate point, ending at a point between the intermediate point and the first end of the perimeter wall.

15. A balcony according to claim 1, wherein the perimeter wall is in the form of a parabola, in the plane of the floor top surface.

16. A balcony according to claim 15, wherein the intermediate point is at the vertex of the parabola.

17. A balcony according to claim 1, wherein the perimeter wall top edge forms a smooth, uninterrupted curve from the first end to the second end of the perimeter wall.

18. A balcony according to claim 1, wherein the perimeter wall comprises a frame of structural members with external cladding.

19. A balcony according to claim 18, wherein the external cladding comprises a concrete shell.

20. A balcony according to claim 1, wherein the balcony comprises a frame of structural members with external cladding.

21. A balcony according to claim 1, further comprising:

a table comprising a table top mounted on a post, the table top being pivotable on the post between a first, locked horizontal position and a second, non-horizontal position; and a support receptacle recessed into the floor of the balcony to removably receive a lower end of the post and support the post in a vertical position.

22. A building, comprising:

a building wall; and a balcony according to claim 1, attached to the building wall, wherein the floor first edge is adjacent to the building wall.

23. A building according to claim 22, wherein two said balconies are attached to the building wall at a common level and within view of each other, and the respective second sections of the balconies are oriented in the same direction.

* * * * *